US009171706B1

(12) United States Patent
Funatsu et al.

(10) Patent No.: US 9,171,706 B1
(45) Date of Patent: Oct. 27, 2015

(54) MASS ANALYSIS DEVICE AND MASS ANALYSIS METHOD

(71) Applicant: SHIMADZU CORPORATION, Kyoto-shi, Kyoto (JP)

(72) Inventors: Shinji Funatsu, Kyoto (JP); Noriyuki Ojima, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/534,749

(22) Filed: Nov. 6, 2014

(51) Int. Cl.
*H01J 49/40* (2006.01)
*H01J 49/00* (2006.01)

(52) U.S. Cl.
CPC ..... *H01J 49/005* (2013.01); *H01J 49/40* (2013.01)

(58) Field of Classification Search
None
See application file for complete search history.

(56) References Cited

U.S. PATENT DOCUMENTS 5,028,777 A * 7/1991 Franzen et al. ..... 250/282
6,504,150 B1 * 1/2003 Verentchikov et al. ..... 250/286
2004/0089799 A1 * 5/2004 Kawato et al. ..... 250/281
2009/0294662 A1 * 12/2009 Belov et al. ..... 250/291
2010/0270465 A1 * 10/2010 Raptakis et al. ..... 250/282
2012/0138788 A1 * 6/2012 Taniguchi ..... 250/287

FOREIGN PATENT DOCUMENTS

JP 2007121178 A * 5/2007 ..... G01N 27/62
JP 2010-256101 A 11/2010
JP 2011-145089 A 7/2011

* cited by examiner

*Primary Examiner* — Michael Logie
(74) *Attorney, Agent, or Firm* — Sughrue Mion, PLLC

(57) ABSTRACT

Mass analysis is performed on the same sample while changing the cooling gas supply rate to the ion trap, i.e. the gas pressure conditions, and the respective mass spectra are obtained. Under high gas, ion energy will decrease and modifiers such as phosphate groups will not detach readily, while under low gas, ion energy will remain high and so detachment of modifiers will occur readily. Thus, between multiple mass spectra obtained while changing the gas pressure, if the mass difference between a peak for which signal intensity increased and a peak for which it decreased corresponds to the mass of a known modifier or an integer multiple thereof, it can be inferred that those peaks have the same basic structure and differ only in the number of modifiers. Thus, such peaks are selected as precursor ions to perform $MS^2$ analysis and structural analysis.

2 Claims, 4 Drawing Sheets

MASS ANALYSIS DEVICE AND MASS ANALYSIS METHOD

TECHNICAL FIELD

The present invention relates to a mass analysis device and mass analysis method wherein ions which are the object of analysis are held temporarily in an ion trap, operations for ion selection and dissociation of selected ions are performed inside the ion trap, and product ions generated by that dissociation are subjected to mass analysis.

BACKGROUND ART

In the identification and structural analysis of macromolecular compounds such as sugar chains and peptides, ion trap mass analysis devices equipped with a MALDI (matrix-assisted laser desorption/ionization) ion source and a three-dimensional quadrupole ion trap are widely used. The technique of mass analysis of various ions held temporarily in the ion trap includes cases where the mass separation function of the ion trap itself is used and cases where ions are transferred all at once from the ion trap and detected after performing mass separation of the ions by means of a time-of-flight mass spectrometer provided outside the ion trap, but here, these will be referred to together as ion trap mass analysis devices.

The general analysis technique for macromolecular compounds using an ion trap mass analysis device is as follows.

The target compound which is the object of analysis is ionized by the MALDI process and captured in the ion trap, after which an ion selection operation is performed, whereby ions derived from the target compound and having a specified mass/charge ratio m/z are selectively left behind in the ion trap as precursor ions, while other unneeded ions are eliminated out of the ion trap. Subsequently, a collision-induced dissociation (CID) gas is introduced into the ion trap, and the precursor ions are excited by the action of a high frequency electric field and made to collide with the CID gas, thereby promoting the dissociation of the precursor ions. In some cases, the target structure will not be adequately dissociated through a single CID operation, so the selection of precursor ions and the CID operation may be repeated multiple times. Product ions which have been finely fragmented by performing one or more CID operations on the ions derived from the target compound are then subjected to ion detection involving mass scanning, to acquire an $MS^n$ spectrum, and this $MS^n$ spectrum is then used, for example, for a database search or the like to identify the compound or infer its structure.

To increase the precision of compound identification and structural analysis as described above, or to shorten the time requirement for measurement and analysis and increase the throughput, it is important to select ions with an appropriate mass/charge ratio as the precursor ions which will be the object of the CID operation. As the general conventional precursor ion selection method, a technique has been employed wherein the peaks appearing in a mass spectrum ($MS^1$ spectrum) acquired by performing regular mass analysis without performing a CID operation are detected, all the peaks that satisfy a predetermined criterion, such as having a signal intensity above a threshold value, are extracted, and the ions corresponding to those peaks are selected as the precursor ions. Normally, numerous peaks which satisfy the predetermined criterion will be present on a mass spectrum, so if $MS^2$ analysis is to be executed on all of them, the measurement alone will take a very long time. Furthermore, as the number of measurements increases, the quantity of sample consumed also becomes accordingly greater, and thus a large amount of sample needs to be prepared.

To avoid the problems described above, a method is conceivable whereby, rather than extracting all the peaks on the mass spectrum which satisfy predetermined criteria, a restriction is imposed wherein, for example, a priority order is applied based on order of intensity, and only a predetermined number of peaks are extracted. However, it is not necessarily the case that peaks of relatively high signal intensity will characterize the structure of the target compound, so simply extracting the peaks mechanically in intensity order or the like may not allow one to select effective precursor ions for identification and structural analysis.

A concrete example will be taken and described in detail. Biological macromolecular compounds such as peptides, which are often taken as the object of analysis in an ion trap mass analysis device, often contain easily detachable modifiers, functional groups and the like. Sialic acid, sulfate groups, phosphate groups and the like are well known as typical modifiers. For example, it is known that sialic acid is preferentially detached through low energy CID in the case of sugar chains to which sialic acid is bonded, which are a type of acidic sugar, or glycopeptides to which a sialic acid-bonded sugar chain has been attached, but this sort of detachment of sialic acid is easily produced not just by the CID process but also by in-source decay and collision with cooling gas in the ion trap (for example, see Patent Literatures 1 and 2). Thus, when the sample contains a compound to which multiple easily detachable modifiers as described above are bonded, in the mass spectrum obtained without executing CID, there will appear a mixture of peaks derived from ions for which the modifiers have not been at all detached from the basic structure, peaks derived from ions for which a portion of modifiers have been detached from the basic structure, and peaks derived from ions for which all the modifiers have been detached from the basic structure. Thus, the mass spectrum becomes quite complex. Furthermore, since the intensity of ions containing the basic structure is distributed over multiple peaks, the intensity of each peak may become relatively lower. In such cases, with the technique of extracting a number of peaks determined according to intensity order, as described above, there is the concern that ions containing the basic structure which provide a good representation of the characteristics of the compound will not be selected as precursor ions.

PRIOR ART LITERATURES

Patent Literatures (Patent Literature 1) Japanese Unexamined Patent Application Publication 2010-256101

(Patent Literature 2) Japanese Unexamined Patent Application Publication 2011-145089

SUMMARY OF THE INVENTION

Problem to be Solved by the Invention

The present invention was made in view of the problems described above, its object being to provide a mass analysis device and mass analysis method wherein, when performing identification and structural analysis of macromolecular compounds in which easily detachable modifiers, functional groups or the like are present, suitable ion peaks which characterize the target compound can be extracted from among the peaks appearing in the mass spectrum and selected as precursor ions for performing $MS^2$ analysis.

Means for Solving the Problem

The first invention, made to resolve the aforementioned problems, is a mass analysis device equipped with an ion trap which temporarily captures ions derived from a target compound which is the object of analysis, and promotes the dissociation of the captured ions, characterized in that it comprises:

a) a gas supply which introduces cooling gas, for cooling the ions captured in the internal space of said ion trap, into said ion trap;

b) an analysis execution unit which executes, on the same sample, multiple mass analyses with different gas pressure conditions in said ion trap created by the gas supplied into the ion trap by said gas supply means; and c) a precursor ion selection unit which, by comparing the signal intensities of peaks of the same mass/charge ratio for the multiple mass spectra acquired under the aforementioned different gas pressure conditions, distinguishes multiple ions having the same basic structure and differing in the number of modifiers bonded to said basic structure, and selects at least one of those ions as a precursor ion.

The second invention, made to resolve the aforementioned problems, is a mass analysis method employing a mass analysis device equipped with an ion trap which temporarily captures ions derived from a target compound which is the object of analysis, and promotes the dissociation of the captured ions, characterized in that it comprises:

a) an analysis execution step in which multiple mass analyses, with different gas pressure conditions in said ion trap created by the cooling gas supplied into the ion trap for cooling the ions captured in the internal space of the ion trap, are executed on the same sample, and the corresponding mass spectra are acquired; and b) a precursor ion selection step in which, by comparing the signal intensities of peaks of the same mass/charge ratio for the multiple mass spectra acquired under the aforementioned different gas pressure conditions, multiple ions having the same basic structure and differing in the number of modifiers bonded to said basic structure are distinguished, and at least one of those ions is selected as a precursor ion.

In an ion trap mass analysis device, generally, for the purpose of improvement of detection sensitivity and mass resolution, a cooling operation is performed for gathering the ions trapped inside the ion trap near the vicinity of the center of the trapping space. Cooling refers to an operation wherein a cooling gas such as He, which is an inert gas, is introduced into the ion trap, and the captured ions are brought into contact with this gas, thereby attenuating the kinetic energy of the ions. Ions with low kinetic energy are readily susceptible to the influence of the trapping electric field, and thus the spatial spread of ions within the trapping space is suppressed and ions more readily gather near the center of the trapping space. Generally, in the series of processes for mass analysis as described above, cooling is performed after ions are introduced from outside into the ion trap or after precursor ions have been dissociated by CID and the generated product ions have been captured.

The compound which is the object of analysis in the first invention and second invention is typically a compound whereof the basic structure has one or multiple modifiers or functional groups bonded thereto, which readily detach in the process of ionization, or in the process of the ions being transported from an externally provided ion source to the ion trap, or in the process of cooling in the ion trap, or the like. Specific examples of such modifiers and functional groups include sialic acid, sulfate groups and phosphate groups.

In cases where the target sample contains a compound having one or more easily detachable modifiers or functional groups bonded to the basic structure, if the gas pressure within the ion trap is low (degree of vacuum is high), then the cooling effect will be weak and the kinetic energy possessed by the trapped ions will be relatively high. Due to this energy, modifiers and functional groups bonded to the basic structure will detach easily. Conversely, if the gas pressure in the ion trap is high (degree of vacuum is low), the cooling effect will be strong and the kinetic energy possessed by the ions will be relatively low. Thus, detachment of modifiers and functional groups bonded to the basic structure will not occur readily. Consequently, between mass spectra acquired for the same sample under different gas pressure, a difference will occur in the intensity of peaks of ions in which one or more modifiers are attached to the same basic structure and peaks of ions from which all the modifiers have been detached. For example, peaks for which the signal intensity becomes high when gas pressure changes from a high state to a low state at the same mass/charge ratio can be inferred to be peaks corresponding to ions from which modifiers have been detached.

In this connection, the precursor ion selection unit in the mass analysis device of the first invention calculates the intensity difference between peaks at each mass/charge ratio, for example, for two mass spectra at different gas pressure conditions, and searches for a set of peaks including a peak for which the intensity difference shows a positive value and one for which the intensity difference shows a negative value, such that the mass/charge ratio difference of the peaks matches the mass of a known modifier or functional group, or an integer multiple thereof. A set of peaks obtained through such a search can be considered to be ions having the same basic structure and differing only in the number of modifiers or functional groups, and thus, for example, one out of the obtained set of peaks is selected as the precursor ion. The precursor ion selected in this manner should provide a good representation of the characteristics of the structure of the target compound. Therefore, using the $MS^2$ spectrum, obtained by dissociating this precursor ion by CID or the like, for identification or structural analysis of the target compound makes it possible to improve the precision of identification and structural analysis.

Effect of the Invention

Based on the mass analysis device of the first invention and the mass analysis method of the second invention, when performing identification and structural analysis of compounds wherein one or multiple easily detachable modifiers or functional groups are bonded to a basic structure, such as peptides which have undergone post-translational modification, it becomes possible to accurately select precursor ions which provide a good representation of the characteristics of that structure. As a result, the precision of identification and structural analysis of macromolecular compounds is improved. Furthermore, it becomes possible to avoid performing $MS^2$ analysis on unsuitable precursor ions, which is not useful for identification or structural analysis, and this is effective for reducing the number of $MS^2$ analyses and shortening the measurement time.

DETAILED DESCRIPTION OF THE EXEMPLARY EMBODIMENTS

A matrix-assisted laser desorption/ionization ion trap time-of-flight mass analysis device (MALDI-IT-TOFMS) which is an example of embodiment of the present invention, and the characteristic mass analysis method executed by this device, will be described below with reference to the appended drawings.

Figure 1:
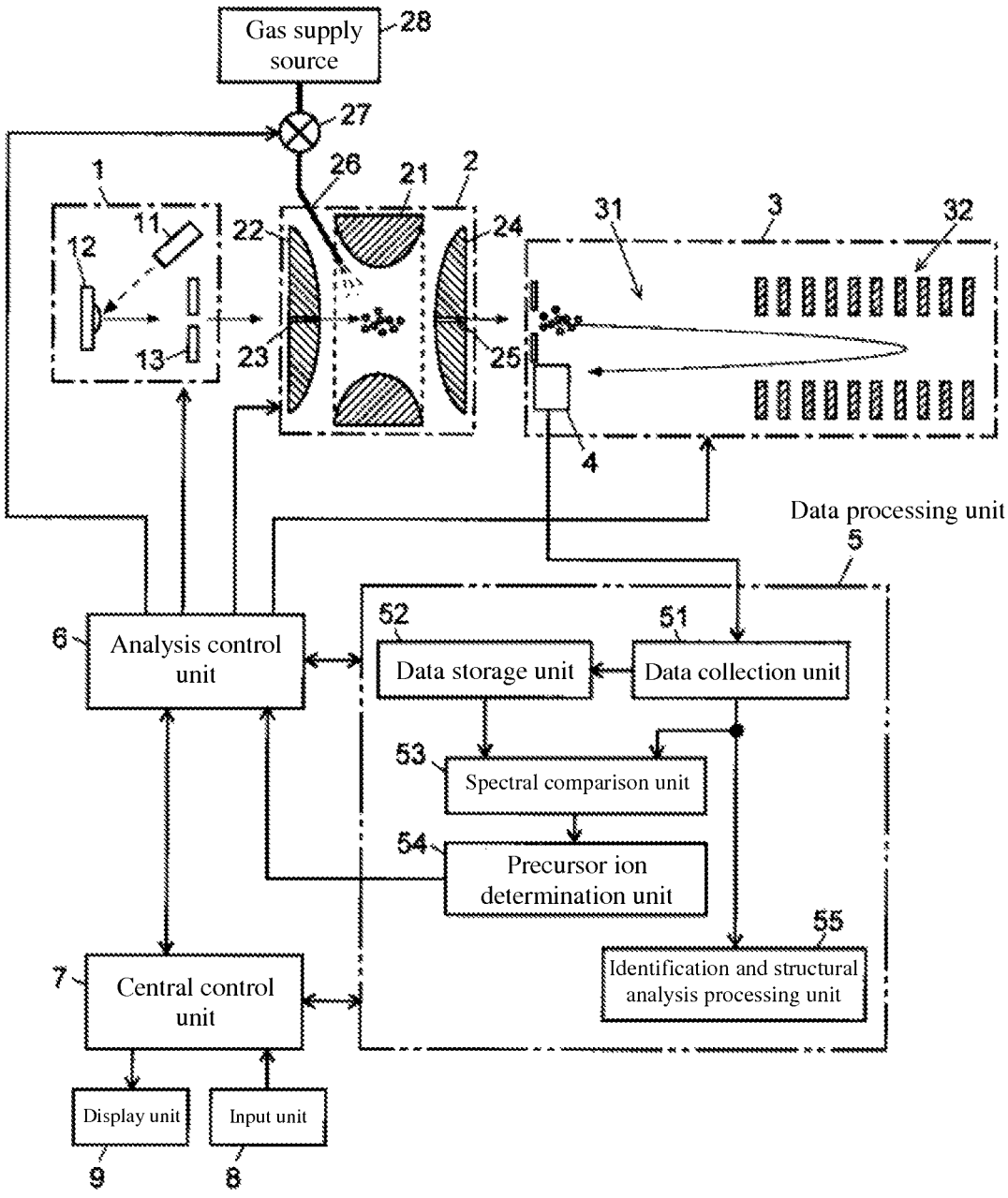
FIG. 1 is a diagram of the essential parts of a MALDI-IT-TOFMS which is one example of embodiment of the present invention.

FIG. 1 is a diagram of the essential parts of the MALDI-IT-TOFMS of the present example of embodiment. This MALDI-IT-TOFMS comprises, within an unillustrated vacuum chamber, an ion source 1 which ionizes a target sample, a three-dimensional quadrupole ion trap 2 which holds ions and dissociates the ions inside it, and a time-of-flight mass analysis unit 3 which separates and detects ions according to mass/charge ratio.

The ion source 1 is a MALDI ion source, comprising a laser irradiation unit 11 which emits pulsed laser light, a sample plate 12 to which a sample S containing the target compound is adhered, an ion optical system 13 which extracts ions released from the sample S through irradiation with laser light and guides the extracted ions, etc.

The ion trap 2 comprises one annular ring electrode 21, and an inlet side end cap electrode 22 and outlet side end cap electrode 24, arranged opposite each other so as to sandwich the ring electrode 21, with the space surrounded by these three electrodes 21, 22 and 24 becoming the trapping area. An ion input port 23 is formed substantially through the center of the inlet side end cap electrode 22, and ions outputted from the ion source 1 are introduced through the ion input port 23 into the ion trap 2. Furthermore, an ion output port 25 is formed substantially through the center of the outlet side end cap electrode 24, and through this ion output port 25, ions from inside the ion trap 2 are released toward the time-of-flight mass analysis unit 3. Furthermore, cooling gas and CID gas are supplied into the ion trap 2 from gas supply source 28 via gas inlet tube 26, the quantity of these gases being controlled by the opening time of a pulse valve 27.

Time-of-flight mass analysis unit 3 comprises a flight space 31 through which ions perform a looping flight by means of a reflectron 32, and an ion detector 4 which detects the ions that have flown through this flight space 31. Ions which have passed from inside the ion trap 2 through ion outlet port 25 and have been released all at once will fly through the flight space 31, but since each ion has a flight speed which depends on its mass/charge ratio, the ions arrive at the ion detector 4 with a time difference which arises during flight according to the mass/charge ratio. The ion detector 4 generates detection signals according to the quantity of inputted ions, and transmits those signals to data processing unit 5.

The data processing unit 5 converts the signals inputted as described above into digital values, generates mass spectra ($MS^n$ spectra) based on that data, and performs qualification (identification), quantitation, structural analysis and the like using the mass spectra. In particular, in order to perform the data processing which is characteristics of the present invention, the data processing unit 5 comprises functional blocks such as data collection unit 51, data storage unit 52, spectral comparison unit 53, precursor ion determination unit 54, and identification and structural analysis processing unit 55.

Analysis control unit 6 has the function of controlling the various units described above, such as the ion source 1, ion trap 2, time-of-flight mass analysis unit 3, data processing unit 5, etc. Furthermore, input unit 8 and display unit 9 are connected to a central control unit 7 which performs input/output control and overall control at a higher level than the analysis control unit 6. It should be noted that data processing unit 5, analysis control unit 6 and central control unit 7 can also be implemented by using a personal computer as a hardware resource and executing thereon specialized processing and control software which has been preinstalled on that personal computer.

Next, the processing and control operations for structural analysis of a compound characteristic of the MALDI-IT-TOFMS of the present example of embodiment will be described with reference to FIG. 2. Here, the compound which is the object of structural analysis is a macromolecular compound containing easily detachable modifiers or functional groups, where typical modifiers and functional groups include sialic acid, sulfate groups, phosphate groups and the like. Typical examples of compounds which can be the object of analysis include sialic acid bonded sugar chains, glycopeptides to which sialic acid bonded sugar chains have been attached, sulfated sugar chains, sulfated peptides, phosphated sugar chains and phosphated peptides. Such compounds are mixed with a predetermined matrix and prepared as the sample S.

When analysis is initiated in accordance with instructions given by the analyst via the input unit 8, first, under control of the analysis control unit 6, mass analysis is performed on the sample S containing the target compound under conditions where the introduction time of cooling gas into the ion trap 2 has been set to T1, and a mass spectrum is generated based on the data obtained through this analysis.

To describe this in more detail, under the control of the analysis control unit 6, the laser irradiation unit 11 emits a short duration laser light. This laser light is irradiated onto the sample S, and the matrix within the sample S is rapidly heated and is gasified along with the target compound. The target compound is thereby ionized. Substantially at the same time or prior to this, the pulse valve 27 is opened for a predetermined time T1 (adequately longer than the subsequently described time T2), and cooling gas is supplied through the gas inlet tube 26 into the ion trap 2. Ions generated through laser irradiation are converged by the electrostatic field formed by the ion optical system 13, and are introduced into the ion trap 2 through the ion input port 23. The introduced ions are captured in the internal space of the ion trap 2 by the electric field formed by high frequency voltage applied to the ring electrode 21.

Upon introduction into the ion trap 2, the ions have a relatively high kinetic energy, but since the ion trap 2 is filled with cooling gas, the captured ions come into contact with the cooling gas and lose kinetic energy. Since the flow rate per unit time of the gas supplied through the gas inlet tube 26 is constant, when the opening time of the pulse valve 27 is longer, the total quantity of cooling gas will be greater and the density of cooling gas inside the ion trap 2 will increase. As shown in FIG. 2 (*a*-1), when the gas density inside the ion trap 2 is higher, the likelihood that ions will contact the gas become higher, and thus the kinetic energy possessed by the ions will become lower. With compound ions to which an easily detachable modifier is bonded, the spontaneous detachment of the modifier will occur more readily when the internal energy of the ions is greater. Therefore, when the gas density in the ion trap 2 is high and the energy of the ions is low, the detachment of modifiers will not be promoted much. As a result, as shown in FIG. 2 (*a*-2), the state where the modifiers 101 are bonded to the basic structure 100 of the ion will be more readily preserved.

In the ion trap 2, after cooling has been performed on the introduced ions for a predetermined period of time, a predetermined direct current voltage is applied to the end cap electrodes 22, 24, causing the captured ions to be released all at once from inside the ion trap 2 and admitted into the time-of-flight mass analysis unit 3. Then, while flying through the flight space 31, the various ions are separated according to their mass/charge ratio, and arrived at the ion detector 4 and are detected. The data collection unit 51 receives signals from the ion detector 4, generates a time-of-flight spectrum representing the ion intensities against time of flight, and then generates a mass spectrum in which time of flight has been converted to mass/charge ratio. As described above, at this time, the modifiers are relatively hard to detach, and thus, as shown in FIG. 2 (*a*-3), on the mass spectrum, the peaks corresponding to ions in a state where modifiers 101 are bonded to the basic structure 100 are observed having high signal intensity. On the other hand, the signal intensities of peaks corresponding to ions in which the modifiers 101 have detached from the basic structure 100 will be low. Mass spectrum data which has been obtained in this manner is stored in data storage unit 52.

Next, under the control of the analysis control unit 6, mass analysis is performed on the sample S containing the target compound under conditions where the introduction time of cooling gas into the ion trap 2 has been set to T2, which is adequately shorter than T1, and a mass spectrum is generated based on the data obtained through this analysis. Here, the opening time of the pulse valve 27 is short, so the density of the cooling gas inside the ion trap 2 is low, as shown in FIG. 2 (*b*-1). Thus, the likelihood that ions will contact the gas is low, and consequently, the kinetic energy possessed by the ions is maintained at a high state without being attenuated much. As a result, spontaneous detachment of modifiers 101 from the basic structure 100 of the ions progresses, and there are more ions in a state where all of the modifiers 101 have detached from the basic structure 100 of the ion or where only a portion of the modifiers 101 remain bonded, as shown in FIG. 2 (*b*-2).

Figure 2:
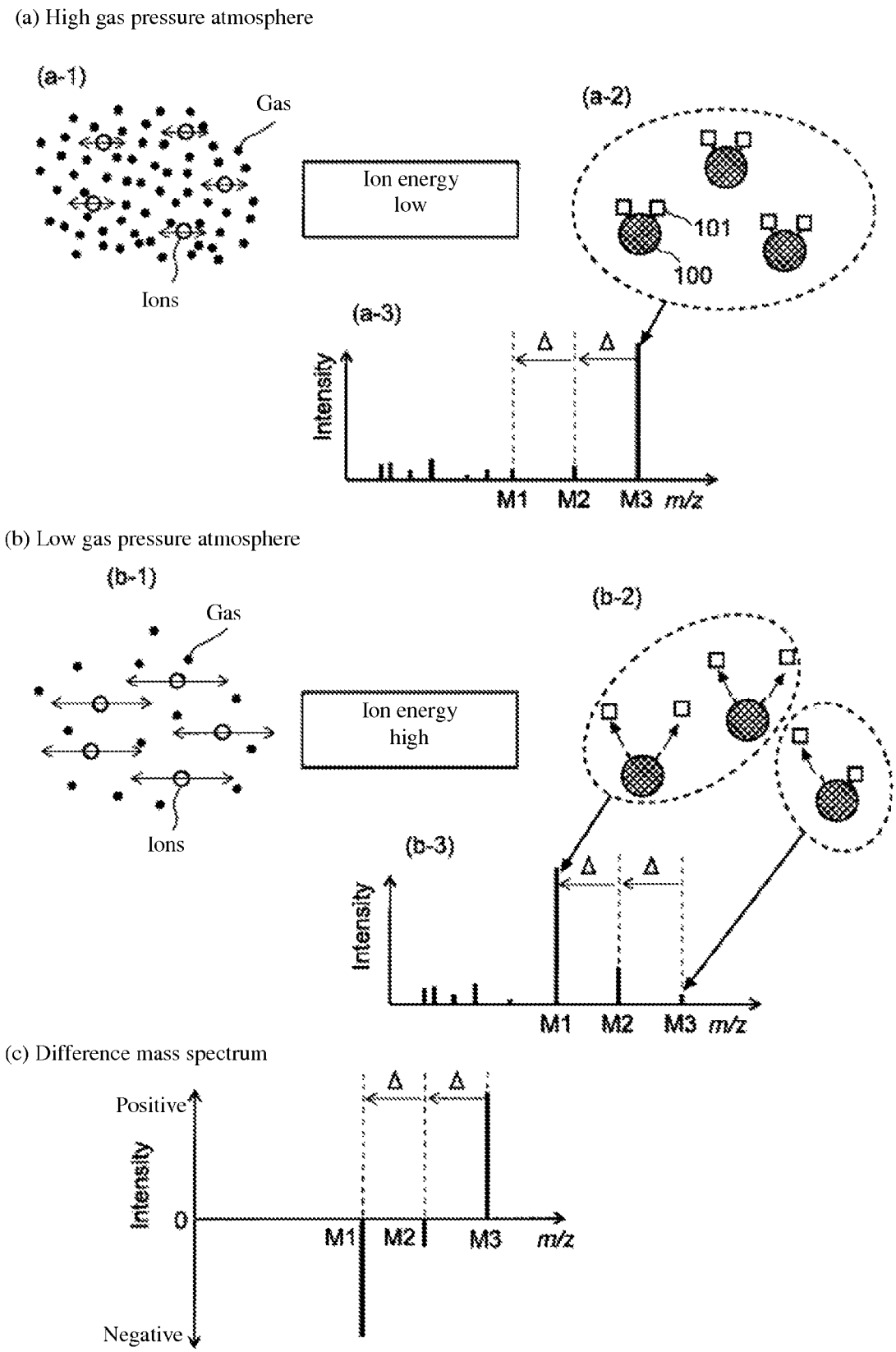
FIG. 2 is a schematic illustration of precursor ion selection in the MALDI-IT-TOFMS of the present example of embodiment.

Therefore, on the mass spectrum generated in the data collection unit 51 in this case, as shown in FIG. 2 (*b*-3), peaks of ions from which no modifiers 101 have detached will be hardly observed, and instead, peaks corresponding to ions from which all the modifiers 101 have detached and peaks corresponding to ions from which a portion of the modifiers 101 have detached will appear at a high signal intensity. As shown in FIG. 2, if the mass/charge ratio of an ion in a state where two of the same modifiers 101 are bonded to a given basic structure 100 is M3, then an ion from which one modifier 101 has detached will have mass/charge ratio M2 that is smaller by an amount corresponding to the mass/charge ratio Δ of that modifier 101. Furthermore, an ion from which all, i.e. two, modifiers 101 have detached will have a mass/charge ratio M1 smaller still by an amount corresponding to the mass/charge ratio Δ of that modifier 101.

Once mass spectra have been obtained under conditions of different gas pressure inside the ion trap 2 as described above, the spectral comparison unit 53 compares the two mass spectra. Specifically, for example, a difference mass spectrum is determined in which, for each mass/charge ratio, the signal intensities of peaks on one mass spectrum have been subtracted from the signal intensities of peaks on the other mass spectrum. FIG. 2 (*c*) is a difference mass spectrum in which the mass spectrum of FIG. 2 (*b*-3) has been subtracted from the mass spectrum of FIG. 2 (*a*-3).

Next, the precursor ion determination unit 54 analyses the difference mass spectrum to select precursor ions suitable for $MS^2$ analysis. For example, in the difference mass spectrum shown in FIG. 2 (*c*), the positive value peak for which the mass/charge ratio is M3 is a peak for which the signal intensity decreased greatly due to change in conditions from high gas pressure to low gas pressure, while the negative value peak for which the mass/charge ratio is M1 is conversely is a peak for which the signal intensity has greatly increased due to the change in conditions from high gas pressure to low gas pressure. The difference in mass/charge ratios for this set of two peaks matches twice the mass of the known modifier 101, so these can be inferred to be peaks derived from ions having the same basic structure. Furthermore, since below the peak for which the mass/charge ratio is M1 there is no peak separated by an amount corresponding to the mass of the modifier 101, it can be inferred that the peak for which the mass/charge ratio is M1 is for ions from which all the modifiers 101 have detached. Thus, either of these two peaks is selected as the precursor ion. The peak to select can be determined according to whether the opening time of the pulse valve 27 is set to T1 or T2 for cooling during $MS^2$ analysis. The reason for this is that it is preferable that the intensity of precursor ions during $MS^2$ analysis be as high as possible, i.e. that the quantity of ions be larger.

The mass/charge ratio of the precursor ion selected by precursor ion determination unit 54 is transmitted to the analysis control unit 6. Subsequently, the analysis control unit 6 controls the various units to perform, on the same sample S, $MS^2$ analysis set to the mass/charge ratio of the selected precursor ion. As a result, voltages are applied to the electrodes 21, 22, 24 such that, after the ions derived from the target compound in the sample S have been captured in the ion trap 2, only the aforementioned selected precursor ions will remain in the ion trap 2 and the other ions will be ejected or eliminated. Thereafter, CID gas is supplied into the ion trap 2 and the ions are subjected to resonant excitation, whereby dissociation of the ions is promoted and the generated product ions are captured in the ion trap 2. The product ions are then released from the ion trap 2 and subjected to mass analysis with the time-of-flight mass analysis unit 3, based on which an $MS^2$ spectrum is generated in the data collection unit 51. The identification and structural analysis processing unit 55, using the mass/charge ratio and intensity of the peaks observed on the $MS^2$ spectrum, infers the structure of the target compound, for example, by performing a database search.

With the MALDI-IT-TOFMS of the present example of embodiment, when selecting precursor ions, it is possible to select ions which provide a good representation of the characteristics of the structure of the target compound as the precursor ions. It is thereby possible to provide much useful information for database searching, thus making it possible to improve the precision of the searching and to infer the structure more accurately. Furthermore, it is possible to avoid simply selecting multiple ions which differ only in the number of attached modifiers as the precursor ions, which eliminates useless $MS^2$ analysis and is effective for shortening the analysis time.

In the example of embodiment described above, the opening time of the pulse valve 27 which supplies cooling gas into the ion trap 2 was changed between two levels to acquire two mass spectra, but it is also possible to acquire mass spectra for the same sample S under a larger number of different gas pressure conditions, determine multiple difference mass spectra between pairs of mass spectra from among that larger number of mass spectra, and select precursor ions based on these multiple difference mass spectra.

Furthermore, in the above example of embodiment, the gas pressure, i.e. gas density, in the ion trap 2 was changed by modifying the opening time of the pulse valve 27 which supplies cooling gas to the ion trap 2, but if a valve capable of changing the gas flow rate is used, it is also possible to do this by changing the gas flow rate.

(Measurement Example)

A measurement example using the processing of the foregoing example of embodiment will be described. The device used was a Shimadzu/Kratos AXIMA-QIT, the sample was 0.5 (μL) of casein digests 1 pmol, the matrix was 0.5 μL of DHBA 12.5 mg/mL solution in 50/50 0.1% TFA/MeCN solvent. Furthermore, there were five pulse valve opening times for cooling gas introduction: 0 (μsec), 25 (μsec), 50 (μsec), 75 (μsec) and 95 (μsec). The normal pulse valve opening time in the mass analysis device used here was 95 (μsec).

Figure 3:
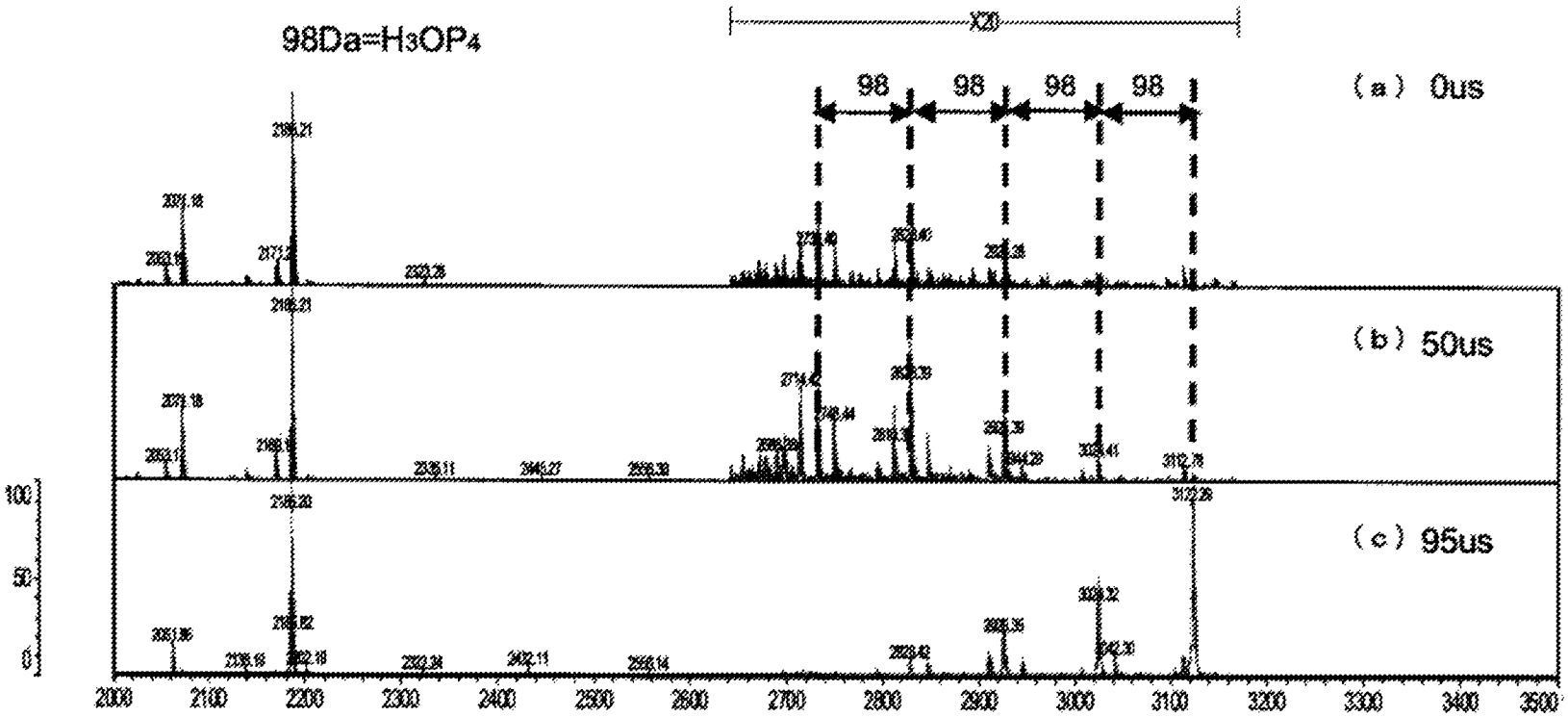
FIG. 3 is a drawing illustrating the comparison of measured mass spectra obtained under different gas pressure conditions.

FIG. 3 is the measured mass spectra when the pulse valve opening time was set to 0 (μsec), 50 (μsec) and 95 (μsec). With an opening time of 95 (μsec), the gas pressure is high and detachment of modifiers does not occur readily, so the signal intensity of the m/z 3122.29 peak is high, and at a position 98 Da×4 downward from that peak, no peak is observed. By contrast, with an opening time of 0 (μsec), the gas pressure is low and separation of modifiers occurs readily, so a peak with a high signal intensity appears at a position 98 Da×4 downward from the m/z 3122.29 peak, and conversely, the signal intensity of the m/z 3122.29 peak is very low. Since the mass/charge ratio difference of these two peaks matches 4 times the mass of a known phosphate group, and since discrete peaks are observed at locations 98 Da apart between the aforementioned two peaks, it can be inferred that the m/z 3122.29 peak is a phosphated peptide, and that the peak at the location 98 Da×4 downward is a peptide from which all the phosphate groups have been detached.

For additional confirmation, mass spectra under different gas pressure conditions were compared by the following technique.

(1) Extract peaks for which the peak intensity (% Area) is 0.2% or greater in the mass spectrum obtained when setting the pulse valve opening time to 95 (μs). These peaks will be designated U.

(2) In each mass spectrum obtained by changing the pulse valve opening time to 0 (μsec), 25 (μsec), 50 (μsec) and 75 (μsec), extract the intensity of peaks for which the mass/charge ratio matches the peaks extracted in (1). The peaks here will be designated N.

(3) For each of the peaks, calculate the intensity ratio P by the following formula (1).

$$P=\{\%\ \text{Total of}\ (N)-\%\ \text{Total of}\ (U)\}/\{\%\ \text{Total of}\ (U)\} \quad (1)$$

Figure 4:
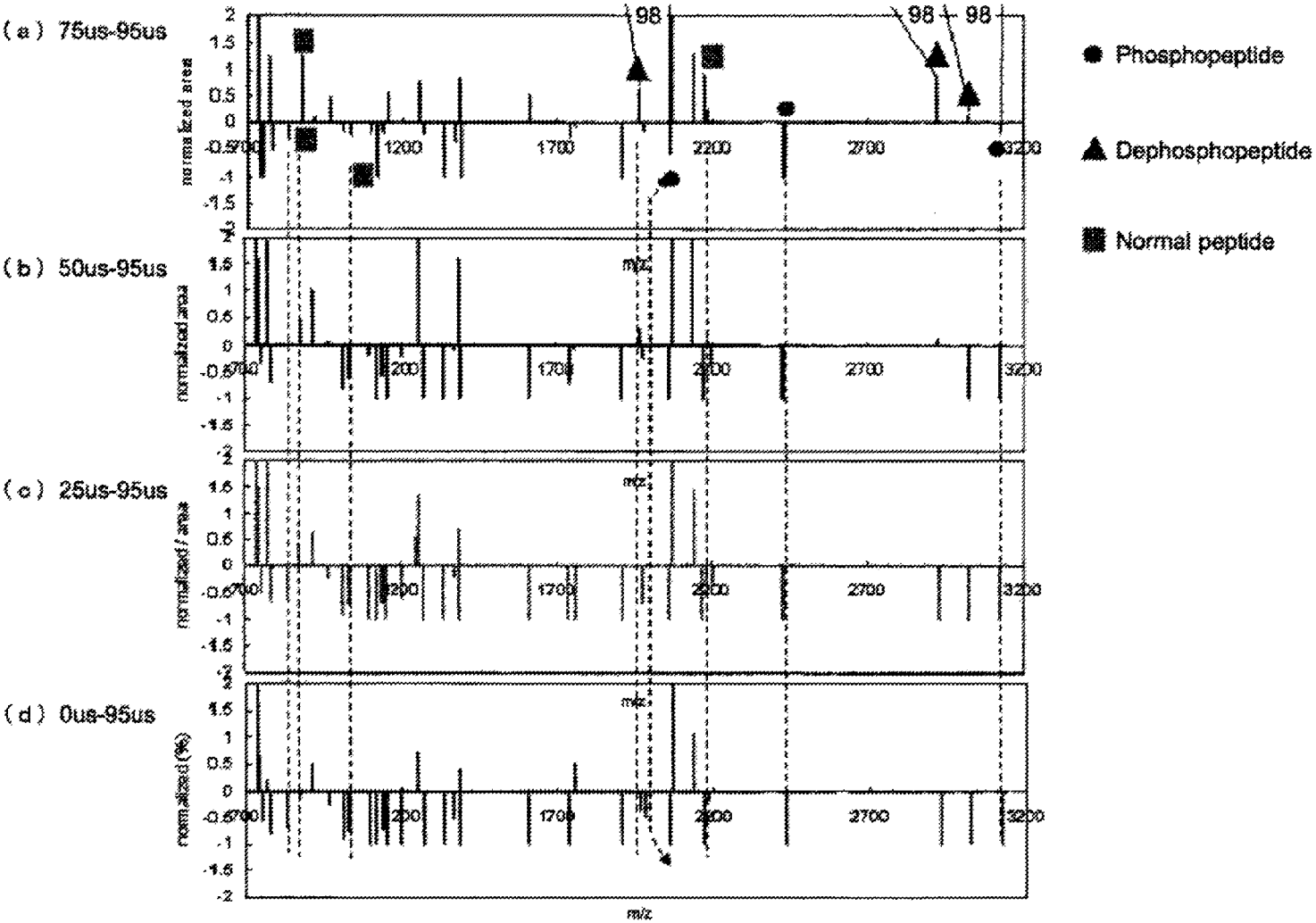
FIG. 4 is a drawing illustrating difference spectra based on measured mass spectra obtained under different gas pressure conditions.

The calculation results are shown in mass spectrum form in FIG. 4. The signal intensity of peptide ions from which phosphate groups have detached, indicated by the symbol ▲ in the drawing, increases when the pulse valve opening time is shortened (when the gas pressure is lowered). On the other hand, the signal intensity of phosphated peptide ions indicated by the symbol ● decreases when the pulse valve opening time is shortened (when the gas pressure is lowered). Besides the peaks indicated by the symbol ●, there are also regular peptides for which the signal intensity decreases. However, it can be seen that for those peaks, there is no paired peak whereof the mass/charge ratio aligns at 98 Da. Therefore, if a set of peaks can be found for which the mass/charge ratio difference corresponds to 98 Da between the peak for which the signal intensity increases and the peak for which it decreases when the pulse valve opening time is shortened, it can be inferred that the peak for which the signal intensity decreases is a peak derived from phosphated peptide. In this way, by searching for a peak for which the signal intensity is increased and a peak for which the signal intensity is decreased as a set, it becomes possible to precisely extract peaks to which a known modifier, functional group or the like is bonded or from which it has detached, making it possible to select useful precursor ions for identification and structural analysis.

It should be noted that the example of embodiment described above is not more than one example of the present invention, and any modifications, corrections, additions, etc. made within the gist of the present invention are of course also included within the scope of patent claims of the present application.

EXPLANATION OF REFERENCES

1 . . . Ion source
11 . . . Laser irradiation unit
12 . . . Sample plate
13 . . . Ion optical system
2 . . . Ion trap
21 . . . Ring electrode
22 . . . Inlet side end cap electrode
23 . . . Ion input port
24 . . . Outlet side end cap electrode
25 . . . Ion output port
26 . . . Gas inlet tube
27 . . . Pulse valve
28 . . . Gas supply source
3 . . . Time-of-flight mass analysis unit
31 . . . Flight space
32 . . . Reflectron
4 . . . Ion detector
5 . . . Data processing unit
51 . . . Data collection unit
52 . . . Data storage unit
53 . . . Spectral comparison unit
54 . . . Precursor ion determination unit
55 . . . Identification and structural analysis processing unit
6 . . . Analysis control unit
7 . . . Central control unit
8 . . . Input unit
9 . . . Display unit

What is claimed:

1. A mass analysis device, comprising:

an ion trap which temporarily captures ions derived from a target compound which is the object of analysis, and promotes the dissociation of the captured ions;

a gas supply which introduces cooling gas, for cooling the ions captured in the internal space of said ion trap, into said ion trap;

an analysis execution unit which executes, on the same sample, multiple mass analyses with different gas pressure conditions in said ion trap created by the gas supplied into the ion trap by said gas supply; and a precursor ion selection unit which, by comparing the signal intensities of peaks of the same mass/charge ratio for the multiple mass spectra acquired under the aforementioned different gas pressure conditions, distinguishes multiple ions having the same basic structure and differing in the number of modifiers bonded to said basic structure, and selects at least one of those ions as a precursor ion.

2. A mass analysis method employing a mass analysis device equipped with an ion trap which temporarily captures ions derived from a target compound which is the object of analysis, and promotes the dissociation of the captured ions, the method comprising:

executing multiple mass analyses, with different gas pressure conditions in said ion trap created by cooling gas supplied into the ion trap for cooling the ions captured in the internal space of the ion trap, on the same sample;

acquiring corresponding mass spectra;

comparing the signal intensities of peaks of the same mass/charge ratio for the multiple mass spectra acquired under the aforementioned different gas pressure conditions, multiple ions having the same basic structure and differing in the number of modifiers bonded to said basic structure are distinguished; and selecting at least one of those ions is selected as a precursor ion.

* * * * *